US006345605B1

(12) United States Patent
Augustin et al.

(10) Patent No.: US 6,345,605 B1
(45) Date of Patent: Feb. 12, 2002

(54) CONFIGURATION AND METHOD FOR AMPLIFYING THE PRESSURE OF FUEL FOR A FUEL INJECTOR

(75) Inventors: Ulrich Augustin, Kernen; Reda Rizk, Köln; Raimondo Giavi, München, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/513,609

(22) Filed: Feb. 25, 2000

(30) Foreign Application Priority Data

Feb. 25, 1999 (DE) ..... 199 08 217

(51) Int. Cl.[7] ..... F02M 33/04
(52) U.S. Cl. ..... 123/446; 123/447; 123/506
(58) Field of Search ..... 123/446, 447, 123/506

(56) References Cited

U.S. PATENT DOCUMENTS 4,417,557 A * 11/1983 Walter ..... 123/467
4,844,035 A * 7/1989 Takagi ..... 123/446
RE33,270 E * 7/1990 Beck et al. ..... 123/446
5,682,858 A 11/1997 Chen et al.

FOREIGN PATENT DOCUMENTS

JP 58-0015757 1/1983
JP 59-141746 8/1984

* cited by examiner

*Primary Examiner*—Thomas N. Moulis
(74) *Attorney, Agent, or Firm*—Herbert L. Lerner; Laurence A. Greenberg; Werner H. Stemer

(57) ABSTRACT

A configuration for amplifying fuel pressure for a fuel injector includes a pressure amplifier having a control space on a low-pressure side, a working space on a high-pressure side, and a moveable ram disposed between the control and working spaces. The control space is connected to an accumulator through a pressure line, and the working space is connected to a fuel line. The device includes an actuator connected to a servovalve for changing between an actuated switched state and an unactuated initial state. In the pressure line is the servovalve between the pressure supply and the control space, which opens the pressure line in the unactuated initial state, and interrupts the pressure line and keeps unpressurized the control space in the actuated switched state. A method for amplifying the fuel pressure includes: connecting the pressure supply to the pressure amplifier, and to the control space through the pressure line; connecting the working space to an injection nozzle with the fuel line; placing the servovalve in the pressure line between the pressure supply and the control space; connecting the actuator to the servovalve; opening the pressure line with the servovalve when the actuator is unactuated; and interrupting the pressure line and keeping unpressurized the control space with the servovalve upon actuation.

7 Claims, 2 Drawing Sheets

CONFIGURATION AND METHOD FOR AMPLIFYING THE PRESSURE OF FUEL FOR A FUEL INJECTOR

BACKGROUND OF THE INVENTION

Field of the Invention

The invention lies in the field of fuel injectors. The invention relates to a configuration and to a method for amplifying the pressure of fuel for a fuel injector.

Use of injection systems that operate with very high injection pressures for supplying fuel to internal combustion engines is increasing. Accumulator-type injection systems in which very high injection pressures are produced by pressure intensification have proven advantageous in this context, particularly for truck diesel engines. An example of a fuel injector with pressure amplification is illustrated in U.S. Pat. No. 5,682,858 to Chen et al.

In the prior art system, a pressure amplifier with a piston is movably disposed in the fuel injector. The piston divides the pressure amplifier into a control space on the low-pressure side and a working space on the high-pressure side. The working space on the high-pressure side of the pressure amplifier is connected to the fuel line in the fuel injector upstream of the actual injection nozzle. The control space on the low-pressure side is connected to an accumulator by an actuator-actuated servovalve formed in the fuel injector.

In the configuration, the servovalve is constructed such that, in the initial state, when the actuator is not actuated, the servovalve interrupts the flow connection between the accumulator and the control space of the pressure amplifier and keeps the control space unpressurized. In the operating state, the working space of the pressure amplifier fills with fuel through the fuel line.

The servovalve is then switched by activation of the actuator so that the flow connection between the accumulator and the control space in the pressure amplifier is opened and the piston in the pressure amplifier is subjected on the control-space side to the pressure in the accumulator. At the same time, the pressure established in the control space is amplified many times over by the piston in the pressure amplifier and transmitted to the fuel situated in the working space at the pressure amplifier.

The high-pressure fuel opens the injection nozzle in the fuel injector and the fuel is injected into a combustion chamber of the internal combustion engine. As soon as the activation of the actuator ends, the servovalve returns to its initial state. Consequently, the flow connection between the accumulator and the control space is, again, interrupted and the control space is returned to the unpressurized state. Then, the pressure on the fuel in the working space of the pressure amplifier falls abruptly and injection ends.

In the prior art accumulator-type injection system with pressure amplification, the quantity of fuel injected is determined by the time window of activation of the actuator and by the configuration of the injection nozzle, i.e., the quantity of fuel injected by the nozzle per unit time. Unavoidable manufacturing tolerances in the injection nozzle, therefore, inevitably detrimentally affects the fuel injector such that the quantity of fuel injected varies from fuel injector to fuel injector. Such variance can lead to nonuniform engine behavior, in particular, lack of engine smoothness, especially for multicylinder engines. Moreover, in the prior art configuration, the end of injection and, hence, the course of combustion in the combustion chamber depend on precise activation of the actuator and of the servovalve.

SUMMARY OF THE INVENTION

It is accordingly an object of the invention to provide a configuration and a method for amplifying the pressure of fuel for a fuel injector that overcomes the hereinafore-mentioned disadvantages of the heretofore-known devices and methods of this general type and that refines existing configurations and methods for amplifying the pressure of fuel for a fuel injector to reduce the effect of manufacturing tolerances and switching operations upon the characteristics of injection into the internal combustion engine.

With the foregoing and other objects in view, there is provided, in accordance with the invention, a configuration for amplifying the pressure of fuel for a fuel injector having an injection nozzle, including a pressure supply containing pressurized medium, a pressure line, a fuel line, a pressure amplifier having a low-pressure side, a high-pressure side, a control space on the low-pressure side, a working space on the high-pressure side, a moveable ram disposed between the control space and the working space, the control space connected to the pressure supply through the pressure line, and the working space connected to the fuel line upstream of an injection nozzle of a fuel injector, an actuator, a servovalve for changing between an actuated switched state and an unactuated initial state, the servovalve connected to and actuated by the actuator, disposed in the pressure line between the pressure supply and the control space, opening the pressure line in the unactuated initial state, and interrupting the pressure line and keeping unpressurized the control space in the actuated switched state when the servovalve is triggered by the actuator.

According to the invention, a servovalve is disposed between a control space of a pressure amplifier (the control space being on the low-pressure side) and an accumulator. The servovalve is actuated by an actuator configured such that, in the initial state, when the actuator is not activated, the servovalve keeps open the flow connection between the accumulator and the control space of the pressure amplifier and, hence, subjects a piston in the pressure amplifier to the pressure prevailing in the accumulator. Only when the actuator is activated is the flow connection between the accumulator and the control space interrupted and the control space kept unpressurized by the servovalve, with the result that the fuel is drawn in by the working space of the pressure amplifier.

In accordance with another feature of the invention, there is provided an outlet, and wherein the servovalve is a 3/2-way valve and connects the control space to the outlet in the actuated switched state.

In accordance with a further feature of the invention, the pressure line includes a restrictor upstream of the servovalve.

With the objects of the invention in view, there is also provided a method for amplifying the pressure of fuel for a fuel injector having an injection nozzle, including the steps of connecting a pressure supply containing a pressurized medium to a pressure amplifier having a low-pressure side, a high-pressure side, a control space on the low-pressure side, a working space on the high-pressure side, and a ram movably disposed between the control space and the working space, providing a pressure line and connecting the pressure supply to the control space with the pressure line, providing a fuel line for guiding fuel, connecting the working space to an upstream side of an injection nozzle of a fuel injector with the fuel line for passing fuel to the working space, providing a servovalve, an actuator, and a pressure line, and placing the servovalve in the pressure line between the pressure supply and the control space of the pressure amplifier, connecting the actuator to the servovalve for actuating the servovalve, opening the pressure line with the servovalve when the actuator is unactuated, and interrupting the pressure line and keeping unpressurized the control space with the servovalve when the actuator is actuated and actuates the servovalve.

In accordance with an added mode of the invention, the beginning of injection is set through the injection nozzle to occur when activation of the actuator ends, causing automatic return of the servovalve to an open position of the pressure line.

In accordance with an additional mode of the invention, the open position of the pressure line is held with the servovalve and the actuator at least until the prevailing pressure of the medium in the control space and acting on the ram has forced fuel completely out of the working space in the pressure amplifier.

In accordance with a concomitant feature of the invention, the quantity of fuel injected is determined by the injection nozzle by the volume of the working space in the pressure amplifier.

The end of actuator activation fixes the beginning of injection through an injection nozzle. The servovalve returns automatically to its initial state and the flow connection between the accumulator and the control space of the pressure amplifier opens again. The pressure established in the control space is amplified many times over by a piston in the pressure amplifier and is transmitted to the fuel in the working space of the pressure amplifier. The fuel subjected to high pressure in the working space causes the injection nozzle to open and fuel to be injected into a combustion chamber of the internal combustion engine. The injection process ends automatically as soon as all the fuel held in the working space of the pressure amplifier has been injected.

According to the invention, the fuel drawn into the working space solely determines the quantity injected. Manufacturing tolerances of the injection nozzle, thus, have no effect on the metered injection quantity. Moreover, the injection process is ended automatically as soon as all the fuel drawn into the working space has been injected. The completion of fuel transfer ensures a sharply defined end to injection and, hence, improved combustion values.

Other features that are considered as characteristic for the invention are set forth in the appended claims.

Although the invention is illustrated and described herein as embodied in a configuration and method for amplifying the pressure of fuel for a fuel injector, it is nevertheless not intended to be limited to the details shown, because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
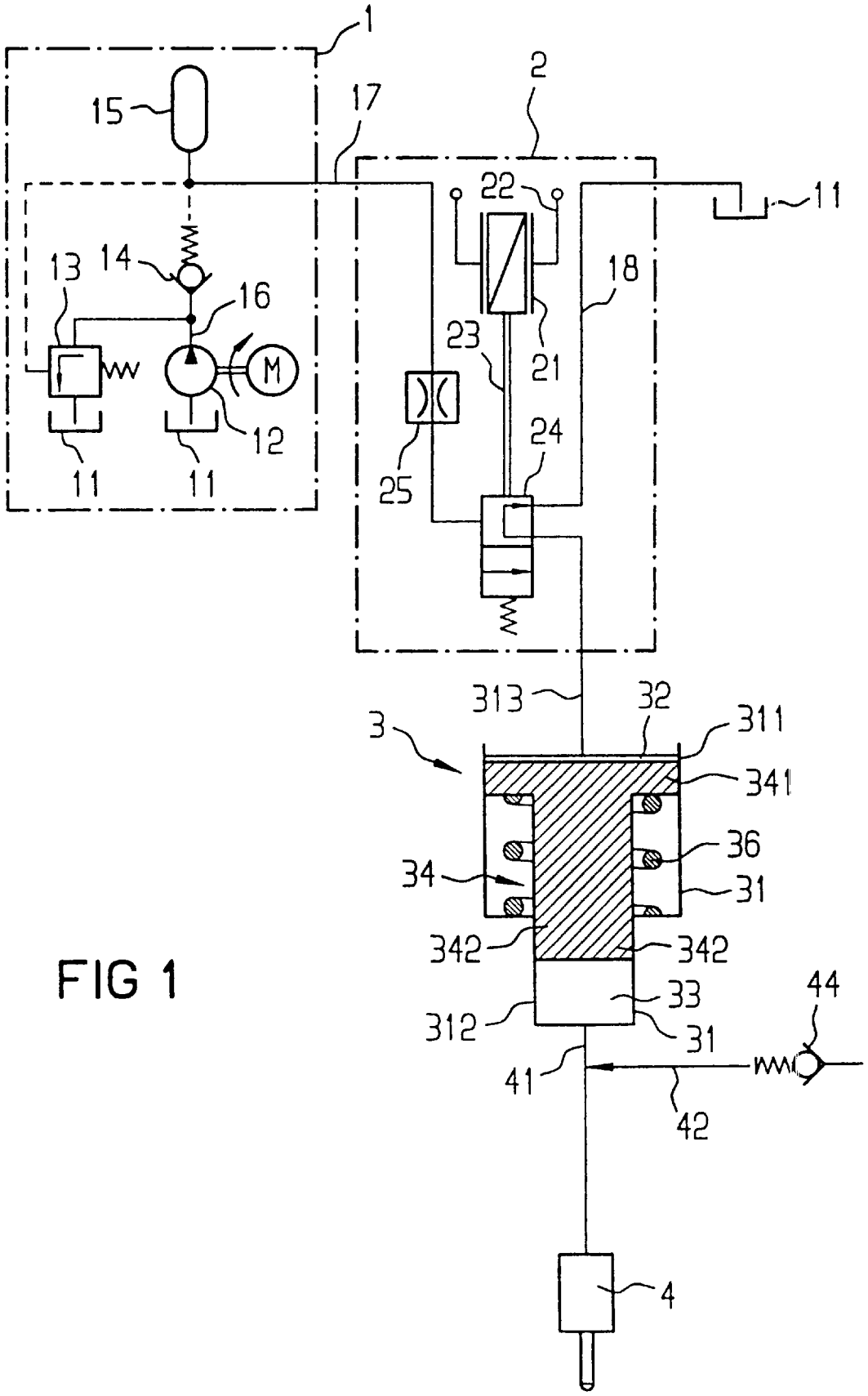
FIG. 1 is a diagrammatic view of an accumulator-type injection system with pressure amplification according to the invention with a servovalve in the activated position.

In all the figures of the drawing, sub-features and integral parts that correspond to one another bear the same reference symbol in each case.

Referring now to the figures of the drawings in detail and first, particularly to FIG. 1 thereof, there is shown an accumulator-type injection system with pressure amplification for an internal combustion engine, in particular, a diesel engine. The injection system includes a pressure supply 1, a servo control 2, a pressure amplifier 3, and an injection nozzle 4. The servo control 2, the pressure amplifier 3, and the injection nozzle 4 are preferably combined in a housing to form a fuel injector.

The pressure supply 1 includes a reservoir 11 that is filled with a medium, preferably oil or fuel. The reservoir 11 fills an accumulator 15 by a pump 12 through a feed line 16. The pressure of the medium in the accumulator 15 is set to a regulated value, preferably in a range of 50 bar to 250 bar, by a pressure relief valve 13 and a check valve 14, which are disposed in the feed line 16 between the pump 12 and the accumulator 15.

Figure 2:
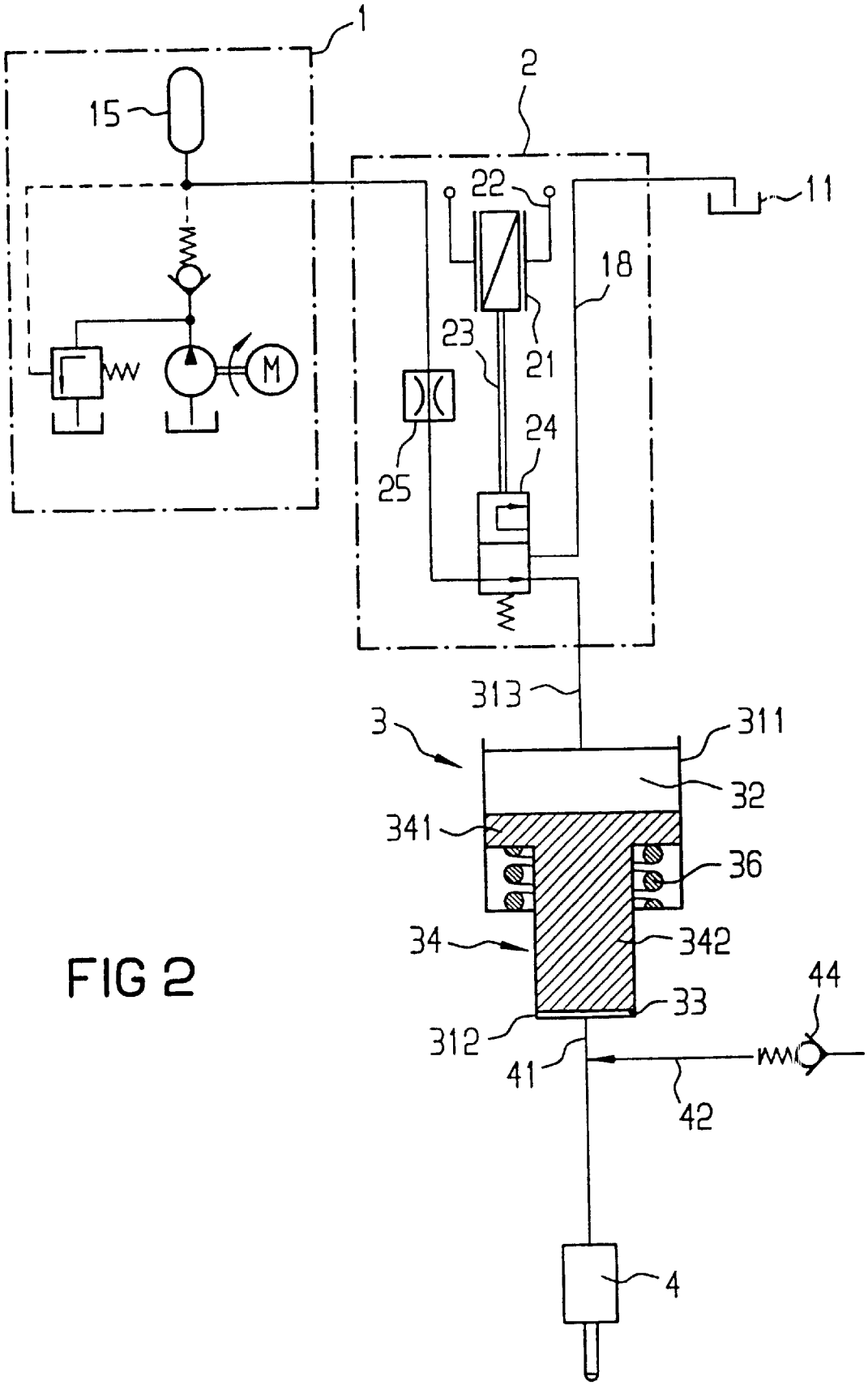
FIG. 2 is a diagrammatic view of FIG. 1 with a servovalve in the deactivated position.

The accumulator 15 is connected through an inlet 17 that leads to an inlet restrictor 25 and then to a servovalve 24 constructed as a 3/2-way valve. An actuator 21 and an operative connection 23 configured as a tappet activates the 3/2-way valve 24. The actuator 21 is activated by a power supply 22. The 3/2-way valve 24 is furthermore configured such that, in the initial state, when the actuator 21 is not activated, the 3/2-way valve connects the inlet 17 from the accumulator 15 to a feed line 313 leading to the pressure amplifier 3 and, thus, produces an open pressure line. The initial (not activated) state of the 3/2-way valve 24 is shown in FIG. 2.

When the actuator 21 is activated by the power supply 22, the 3/2-way valve 24 is switched such that the connection between the inlet 17 from the accumulator 15 and the feed line 313 to the pressure amplifier 3 is interrupted and the feed line 313 to the pressure amplifier 3 is instead connected to the reservoir 11 by an outlet 18. The position of the 3/2-way valve 24 in the operating state is shown in FIG. 1.

The pressure amplifier 3 has a housing 31 in which is formed a two-stage cylindrical internal hole. The upper stage 311 of the hole, which serves as a control-space hole, has a larger diameter than the lower stage 312 of the hole, which serves as a working-space hole. There is a ram 34 movably disposed in the internal hole of the housing 31 along the axis of the hole. The ram 34 has a control piston 341 and a working piston 342. The control piston 341 is guided in the control-space hole 311 and is sealed with respect to the control-space hole. Similarly, the working piston 342 is guided in the working-space hole 312 and is sealed with respect to the working-space hole.

A compression spring 36 is disposed around the working piston 342, one end of the compression spring 36 is supported against the step between the control-space hole 311 and the working-space hole 312, and the other end rests against the control piston 341. Because the ram 34 is shorter than the internal hole in the housing 31, a control space 32 is formed between the end face of the control piston 341 and the housing 31, and a working space 33 is formed between the end face of the working piston 342 and the housing 31. As such, the control space 32 is connected to the 3/2-way valve 24 through the feed line 313. Moreover, the working space 33 is connected to a fuel feed line 42 and an injection line 41. The injection nozzle 4 is connected to a fuel supply through the injection line 41.

If, as illustrated in FIG. 1, the 3/2-way valve 24 is actuated by the actuator 21, the 3/2-way valve establishes a connection between the feed line 313 into the control space 32 and the outlet 18, thereby keeping the control space 32 unpressurized. The holding force of the compression spring 36 then keeps the pressure amplifier 3 in a position such that the control space 32 is reduced to a minimum volume and the working space 33 has its maximum volume. In this position of the pressure amplifier 3, the working space 33 of the pressure amplifier 3 fills with fuel through the fuel feed line 42.

If, on the other hand, as shown in FIG. 2, the 3/2-way valve 24 is unactuated, the connection between the inlet 17 and the feed line 313 into the control space 32 is open, with the result that medium passes out of the accumulator 15 into the control space 32 through the inlet 17, the restrictor 25, the 3/2-way valve 24, and the feed line 313. In the configuration, the inlet restrictor 25 ensures controlled inflow of the pressurized medium from the accumulator 15. The force that is then exerted on the end face of the control piston 341 by the medium in the control space 32 is transmitted to the fuel and working space 33 by the working piston 342 connected to the control piston 341, and the pressure is amplified because the end face of the working piston is significantly smaller. The ratio of the areas of the end face of the control piston 341 and the end face of the working piston 342, which ratio determines the pressure amplification, is preferably chosen so that a pressure of 1500 bar is achieved in the working space 33.

The fuel in the working space 33 is available to the injection nozzle 4 through the injection line 41. A check valve 44 is disposed upstream of the pressure amplifier 3 in the fuel feed line 42 preventing the fuel from flowing upstream of the check valve 44, upstream being defined as opposite the arrow representing the fuel feed line 42. The high pressure of the fuel acting on the injection nozzle 4 then opens the injection nozzle 4 in a conventional manner, and the fuel in the working space 33 is injected into a combustion chamber of an internal combustion engine. During the injection process, the ram 34, including the control piston 341 and the working piston 342, forces the fuel out of the working space 33 until the end position shown in FIG. 2 is reached. In the end position, the working space is empty and the entire quantity of fuel has been injected from the working space 33 into the combustion chamber, leading to an abrupt end of the injection process.

The accumulator-type injection system shown in FIGS. 1 and 2, with pressure amplification, performs the following injection process:

The pressure supply 1 ensures a regulated pressure of the medium in the accumulator 15, preferably in a range of 50 bar to 250 bar. In the initial position shown in FIG. 2, the unactuated 3/2-way valve 24 is open, thereby establishing a flow connection through the inlet 17 and the feed line 313 to the control space 32, and filling the control space 32 with medium. If the actuator 21 is then activated by the power supply 22 (FIG. 1), the actuator 21 switches the 3/2-way valve 24 over through the tappet 23, and the flow connection between the accumulator 15 and the control space 32 is interrupted. The 3/2-way valve 24 simultaneously opens a connection between the feed line 313 and the outlet 18, thereby depressurizing the control space 32. The compression spring 36 in the pressure amplifier 3 then forces the control piston 341 back into the control space 32, with the result that the control space 32 empties and the medium flows back into the reservoir 11. The working piston 342 connected to the control piston 341 is retracted at the same time as the control piston 341, and fuel is drawn into the working space 33 through the fuel feed line 42. The progress of the filling phase with respect to time is determined by the force exerted by the compression spring 36 and the supply pressure prevailing in the fuel feed line 42. FIG. 1 shows the accumulator-type injection system in a position where the control space 32 is minimized and the working space 33 is completely filled with fuel.

The beginning of injection into the combustion chamber of the internal combustion engine is fixed by interrupting the power supply 22 of the actuator 21. The activation of the 3/2-way valve 24 by the actuator 21 and the tappet 22 is then ended, and the 3/2-way valve 24 returns to its initial state, shown in FIG. 2. In the initial state, the flow connection from the accumulator 15 to the control space 32 through the inlet 17 and the feed line 313 is open. The pressure in the control space 32 then rises to the pressure prevailing in the accumulator 15. Through the ram 34, the pressure in the control space 32 is transmitted with amplification to the fuel in the working space 33. The fuel pressure, which is then preferably in a range above 1500 bar, is simultaneously applied to the injection nozzle 4 through the injection line 41, and has the effect that the injection nozzle 4 opens and fuel is injected into the combustion chamber of the internal combustion engine.

During the injection process, the control space 32 fills with medium and the control piston 341 of the ram 34 is forced counter to the retaining force of the compression spring 36 by the prevailing pressure of the medium in the control space 32. At the same time, the working piston 342, which is firmly connected to the control piston 341, forces the fuel out of the working space 33 into the injection nozzle 4 and, hence, into the combustion chamber of the internal combustion engine. As soon as the entire quantity of fuel contained in the working space 33 has been injected into the combustion chamber through the injection nozzle 4, the fuel pressure at the injection nozzle 4 falls to a level where the injection nozzle 4 closes automatically, thereby ending the injection process. If the power supply 22 of the actuator 21 is then activated, as shown in FIG. 1, the 3/2-way valve 24 is actuated again and the flow connection between the accumulator 15 and the control space 32 is interrupted, thus reinitiating fuel intake as described above.

In the accumulator-type injection system according to the invention and in the method for controlling it, the quantity of fuel injected is determined by the configuration with respect to time of the filling phase of the working space 33 of the pressure amplifier 3 and, in particular, by the volume of the working space 33. The unavoidable manufacturing tolerances in the injection nozzle 4, thus, have no effect on the metering of the injection quantity. Moreover, the complete emptying of the working space 33 during injection ensures that injection is ended automatically, regardless of the operating speed of the 3/2-way valve 24. The sharply defined end to injection ensures good combustion values in the combustion chamber of the internal combustion engine.

We claim:

1. A configuration for amplifying the pressure of fuel for a fuel injector having an injection nozzle, comprising:

a pressure supply containing pressurized medium;

a pressure line;

a fuel line;

a pressure amplifier having a low-pressure side, a high-pressure side, a control space on said low-pressure side, a working space on said high-pressure side, a moveable ram disposed between said control space and said working space, a compression spring forcing said moveable ram towards said control space and away from said working space;

said control space connected to said pressure supply through said pressure line, and said working space connected to said fuel line upstream of an injection nozzle of a fuel injector;

an actuator;

a servovalve for changing between an actuated switched state and an unactuated initial state, said servovalve connected to and actuated by said actuator, disposed in said pressure line between said pressure supply and said control space, opening said pressure line in said unactuated initial state, and interrupting said pressure line and keeping unpressurized said control space in said actuated switched state when said servovalve is triggered by said actuator.

2. The configuration according to claim 1, including an outlet, and wherein said servovalve is a 3/2-way valve and connects said control space to said outlet in said actuated switched state.

3. The configuration according to claim 1, wherein said pressure line includes a restrictor upstream of said servovalve.

4. A method for amplifying the pressure of fuel for a fuel injector having an injection nozzle, which comprises:

connecting a pressure supply containing a pressurized medium to a pressure amplifier having a low-pressure side, a high-pressure side, a control space on the low-pressure side, a working space on the high-pressure side, a ram movably disposed between the control space and the working space, and a compression spring forcing the ram towards the control space and away from the working space;

providing a pressure line and connecting the pressure supply to the control space with the pressure line;

providing a fuel line for guiding fuel;

connecting the working space to an upstream side of an injection nozzle of a fuel injector with the fuel line for passing fuel to the working space;

providing a servovalve, an actuator, and a pressure line, and placing the servovalve in the pressure line between the pressure supply and the control space of the pressure amplifier;

connecting the actuator to the servovalve for actuating the servovalve;

opening the pressure line with the servovalve when the actuator is unactuated; and interrupting the pressure line and keeping unpressurized the control space with the servovalve when the actuator is actuated and actuates the servovalve.

5. The method according to claim 4, which comprises setting the beginning of injection through the injection nozzle to occur when activation of the actuator ends, causing automatic return of the servovalve to an open position of the pressure line.

6. The method according to claim 5, which comprises holding the open position of the pressure line with the servovalve and the actuator at least until the prevailing pressure of the medium in the control space and acting on the ram has forced fuel completely out of the working space in the pressure amplifier.

7. The method according to claim 4, which comprises determining the quantity of fuel injected by the injection nozzle by the volume of the working space in the pressure amplifier.

* * * * *